US006893221B2

(12) United States Patent
Miller et al.

(10) Patent No.: US 6,893,221 B2
(45) Date of Patent: May 17, 2005

(54) FAN CONTROL

(75) Inventors: Dennis Patrick Miller, Fullerton, CA (US); Douglas G. Gilliland, Santa Ana, CA (US)

(73) Assignee: ADC DSL Systems, Inc., Eden Prairie, MN (US)

( * ) Notice: Subject to any disclaimer, the term of this patent is extended or adjusted under 35 U.S.C. 154(b) by 173 days.

(21) Appl. No.: 10/205,985

(22) Filed: Jul. 26, 2002

(65) Prior Publication Data

US 2004/0018079 A1 Jan. 29, 2004

(51) Int. Cl.[7] ..... F04D 27/00

(52) U.S. Cl. ..... 416/1; 416/39; 417/53; 415/1

(58) Field of Search ..... 415/1, 13, 47–49, 415/51, 118; 416/1, 31, 39, 61; 417/12, 53

(56) References Cited

U.S. PATENT DOCUMENTS 4,756,473 A * 7/1988 Takemae et al. ..... 236/49.3
5,831,405 A * 11/1998 Massie ..... 318/471
6,170,275 B1 * 1/2001 Ueno et al. ..... 416/39

OTHER PUBLICATIONS

Microchip, "TC652/TC653 Integrated Temperature Sensor & Brushless DC Fan Controller with FanSense Detect & Over–Temperature" 2002 Microchip Technology Inc., 14 pgs.

Microchip, "PIC12C67X 8–Pin, 8–bit CMOS Microcontroller with A/D Converter and EEPROM Data Memory", 1999 Microchip Technology Inc., 129 pages.

* cited by examiner

*Primary Examiner*—Edward K. Look
*Assistant Examiner*—Richard A Edgar
(74) *Attorney, Agent, or Firm*—Fogg and Associates, LLC; Laura A. Ryan

(57) ABSTRACT

A method for controlling fan operation that includes detecting a stopped fan and attempting to start the stopped fan. The method includes attempting to start the stopped fan again after at least one first time interval when the fan does not start. The method includes attempting to start the stopped fan again after at least one second time interval when the fan does not start after a predetermined number of first time intervals, where the at least one second time interval is longer than the first time interval.

23 Claims, 4 Drawing Sheets

FAN CONTROL

TECHNICAL FIELD

The present invention relates generally to the field of fans and, in particular, to controlling fans.

BACKGROUND

Fans are frequently used, for example, to push, pull, or circulate air through housings containing electronic equipment for cooling the electronic equipment. In some applications, controllers control these fans. For example, controllers can control fan speed, shut down malfunctioning fans, issue alarms when fans malfunction, etc. Many fan controllers place fans in a fault mode in the case of a fan fault, such as when fans are accidentally stopped, e.g., by an obstruction. In one application, a fault mode consists of issuing an alarm and no longer supplying power to the fan when a fan fault occurs. Problems occur, however, in cases of temporary fan faults, e.g., when a fan is temporarily obstructed and the obstruction is subsequently removed, thereby removing the fault. This is because many controllers require human intervention to restart the fan when the temporary obstruction is removed.

In some applications, fan controllers shut down fans at temperatures that can cause fan lubricants to freeze. This is often referred to as thermal shut down. However, while in a thermal shutdown mode, many controllers indicate that all fans are operable even though one or more of the fans became inoperable, e.g., due to an obstruction, prior to thermal shut down. Similar problems can occur when fans are manually shut down.

For the reasons stated above, and for other reasons stated below that will become apparent to those skilled in the art upon reading and understanding the present specification, there is a need in the art for alternatives for controlling fans.

SUMMARY

The above-mentioned problems with controlling fans and other problems are addressed by embodiments of the present invention and will be understood by reading and studying the following specification.

One embodiment provides a method for restarting a stopped fan. The method includes attempting to start the stopped fan and attempting to start the stopped fan again after at least one first time interval when the fan does not start. The method also includes attempting to start the stopped fan again after at least one second time interval when the fan does not start after a predetermined number of first time intervals, where the at least one second time interval is longer than the first time interval.

Another embodiment provides a method for controlling fan operation that includes detecting a stopped fan and attempting to start the stopped fan. The method includes attempting to start the stopped fan again after at least one first time interval when the fan does not start. The method includes attempting to start the stopped fan again after at least one second time interval when the fan does not start after a predetermined number of first time intervals, where the at least one second time interval is longer than the first time interval.

Another embodiment provides a method for controlling fan operation that includes detecting a stopped fan and executing a restart method for starting the stopped fan. The method includes terminating the restart method when a shutdown condition occurs and retaining a stopped-fan fault indicative of the stopped fan when the shutdown condition occurs. The method includes executing the restart method for starting the stopped fan when the shutdown condition no longer exists.

Further embodiments of the invention include methods and apparatus of varying scope.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Figure 1:
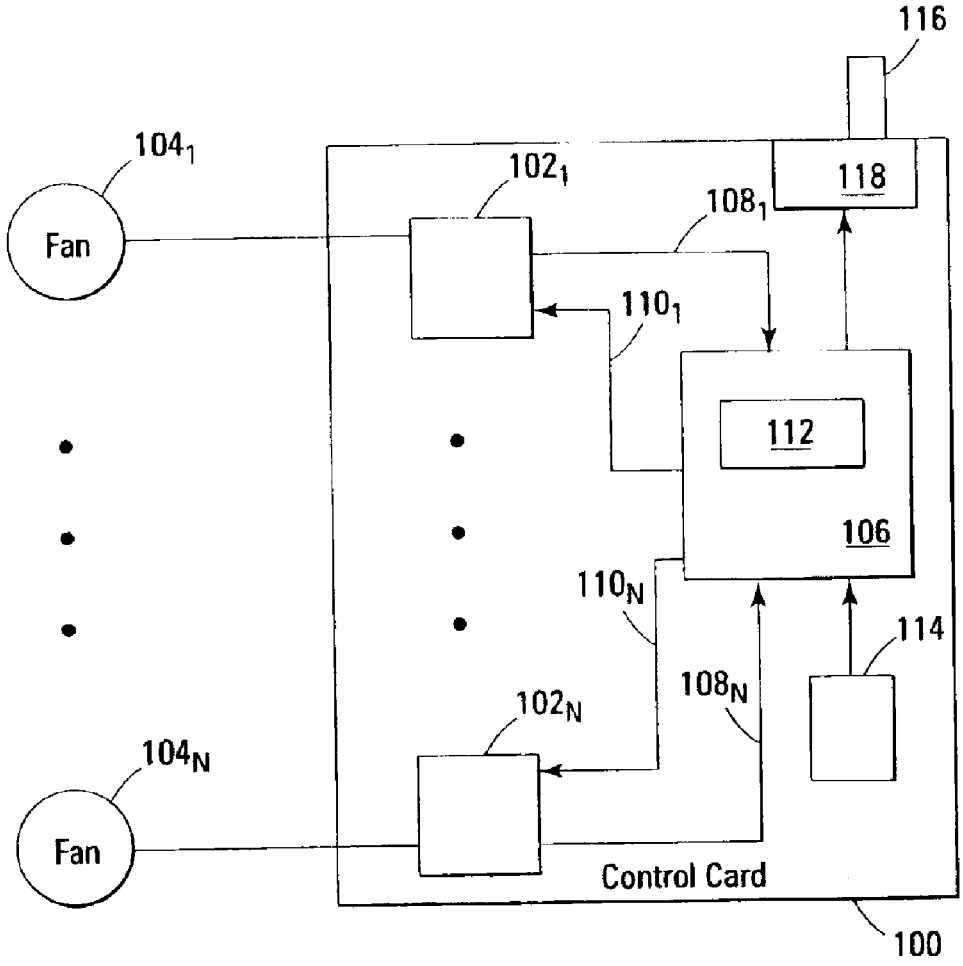
FIG. 1 illustrates a circuit card for controlling fans according to an embodiment of the present invention.

FIG. 1 illustrates a circuit card 100 for controlling fans $\mathbf{104}_1$ to $\mathbf{104}_N$ according to an embodiment of the present invention. In one embodiment, circuit card 100 includes controllers $\mathbf{102}_1$ to $\mathbf{102}_N$ that are respectively electrically connectable to fans $\mathbf{104}_1$ to $\mathbf{104}_N$. Controllers $\mathbf{102}_1$ to $\mathbf{102}_N$ are respectively electrically connected to a controller 106, e.g., by traces $\mathbf{108}_1$ and $\mathbf{110}_1$ to $\mathbf{108}_N$ and $\mathbf{110}_N$ disposed within or on circuit card 100. Controller 106 includes a machine-readable medium 112, such as an programmable read only memory (PROM), erasable PROM (EPROM) electrically erasable PROM (EEPROM) or the like, containing machine-usable instructions. In various embodiments, controllers 102 are fan controllers available as part number TC652 from Microchip Technology Incorporated, Chandler, Ariz. In other embodiments, controller 106 is a Programmable Interrupt Controller (PIC), such as the PIC 12C671 available from Microchip Technology Incorporated, Chandler, Ariz.

In some embodiments, a temperature sensor 114 is disposed on circuit card 100 and is electrically connected to controller 106. Temperature sensor 114 transmits temperature information to controller 106. In other embodiments, an alarm indicator 116 is electrically connected to controller 106 by a connector 118 disposed on circuit card 100. In one embodiment, alarm indicator 116 is a visual indicator that flashes when activated, such as a light emitting diode (LED).

Circuit card 100 monitors and controls operation of fans $\mathbf{104}_1$ to $\mathbf{104}_N$. In one embodiment, controllers $\mathbf{102}_1$ to $\mathbf{102}_N$ respectively monitor rotational speeds of fans $\mathbf{104}_1$ to $\mathbf{104}_N$ and detect when one or more of fans $\mathbf{104}_1$ to $\mathbf{104}_N$ stops, e.g., a stopped-fan fault. For example, when the rotational speed of one of one or more of fans 104 drops to substantially zero revolutions per minute, the respective one or more of controllers $102_1$ to $102_N$ send a fault signal to controller 106 via the respective one or more of traces 108, and the machine-usable instructions contained in machine-readable medium 112 of controller 106 activate alarm indicator 116.

Figure 2:
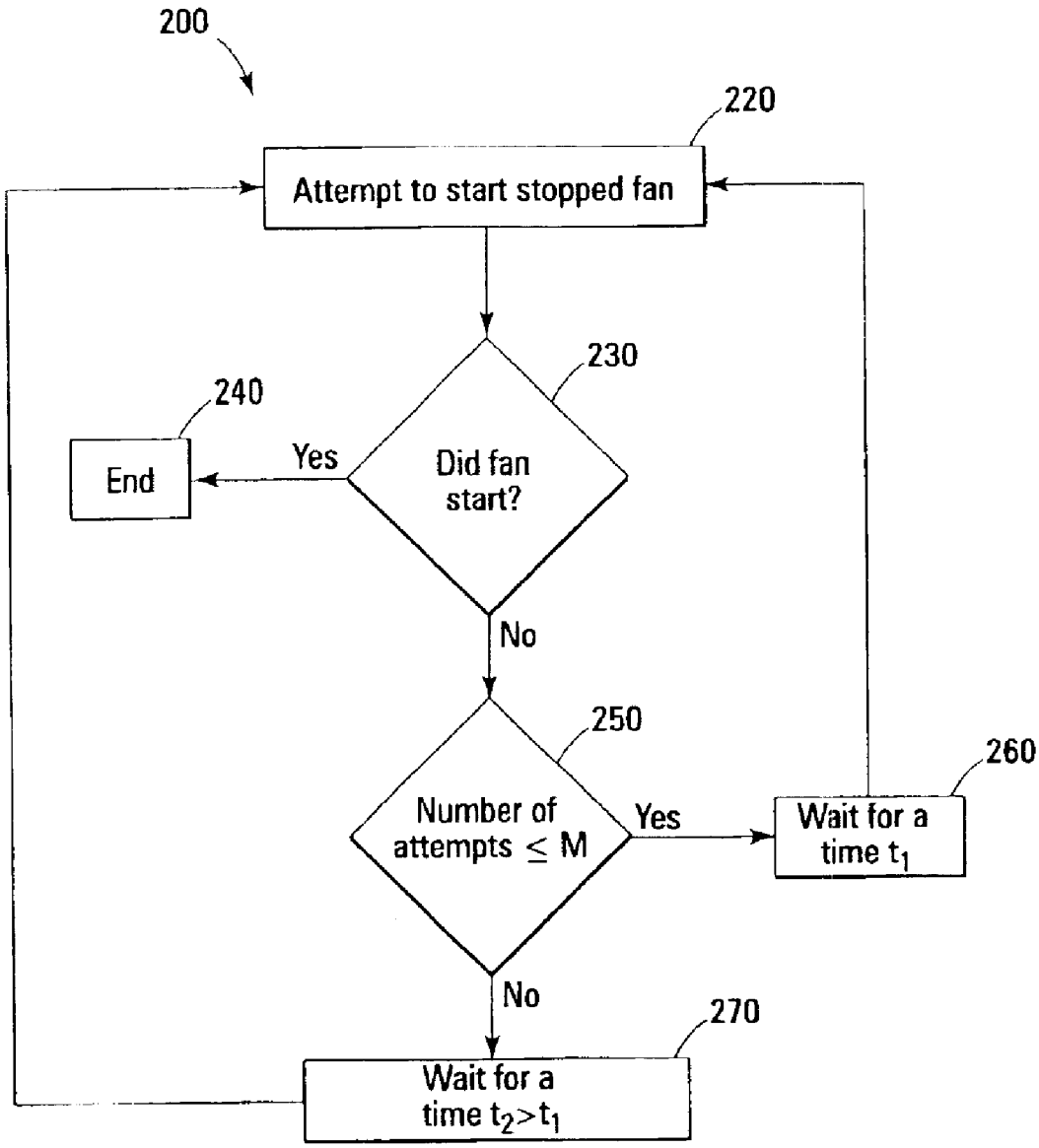
FIG. 2 is a flowchart of a method for restarting a stopped fan according to another embodiment of the present invention.

FIG. 2 is a flowchart of a method 200 for restarting a stopped fan, such as fan $104_1$, according to an embodiment of the present invention. In one embodiment, the respective one of controllers 102, e.g., controller $102_1$, detected the stopped fan, as described above. At block 220, circuit card 100 attempts to start fan $104_1$. In one embodiment, controller $102_1$ receives a control signal from controller 106 via trace $110_1$ to attempt to start fan $104_1$. The control signal instructs controller $102_1$ to send a power signal to fan $104_1$ to start fan $104_1$. If fan $104_1$ starts, it is decided at decision block 230, to end the method at block 240. In one embodiment, when fan $104_1$ starts, controller 106 deactivates alarm indicator 116.

If fan $104_1$ does not start, it is decided at decision block 230, to proceed to decision block 250. If the number of attempts to start fan $104_1$ is less than or equal to M, e.g., M=3 or 4 attempts, it is decided at decision block 250 to wait for a time interval $t_1$, e.g., $t_1$=4 seconds, at block 260 and to attempt to start fan $104_1$ again by returning to block 220. This is repeated for M attempts (or M time intervals $t_1$). If fan $104_1$ does not start after M attempts (or M time intervals $t_1$), it is decided at decision block 250 to wait for a time interval $t_2>t_1$ at block 270 and to attempt to start fan $104_1$ again by returning to block 220. It is attempted to start fan $104_1$ after each of a number of time intervals $t_2$ until the fan starts. Increasing the time interval from $t_1$ to $t_2$ reduces power consumption associated with attempting to start fan $104_1$ during each time interval. Method 200 is not limited to restarting only one fan, but can be used to restart any number of fans $104_1$ to $104_N$ that have stopped.

In one embodiment, circuit card 100 adjusts fan speed according to the temperature sensed by temperature sensor 114. For example, in one embodiment, the fan speed ranges from a predetermined percentage of full speed (e.g., 40 percent of full speed) at a sensor temperature less than or equal to a predetermined temperature $T_1$ (e.g., about 25° C. to 35° C.) to full speed at a sensor temperature greater than or equal to a predetermined temperature $T_2>T_1$.

Figure 3:
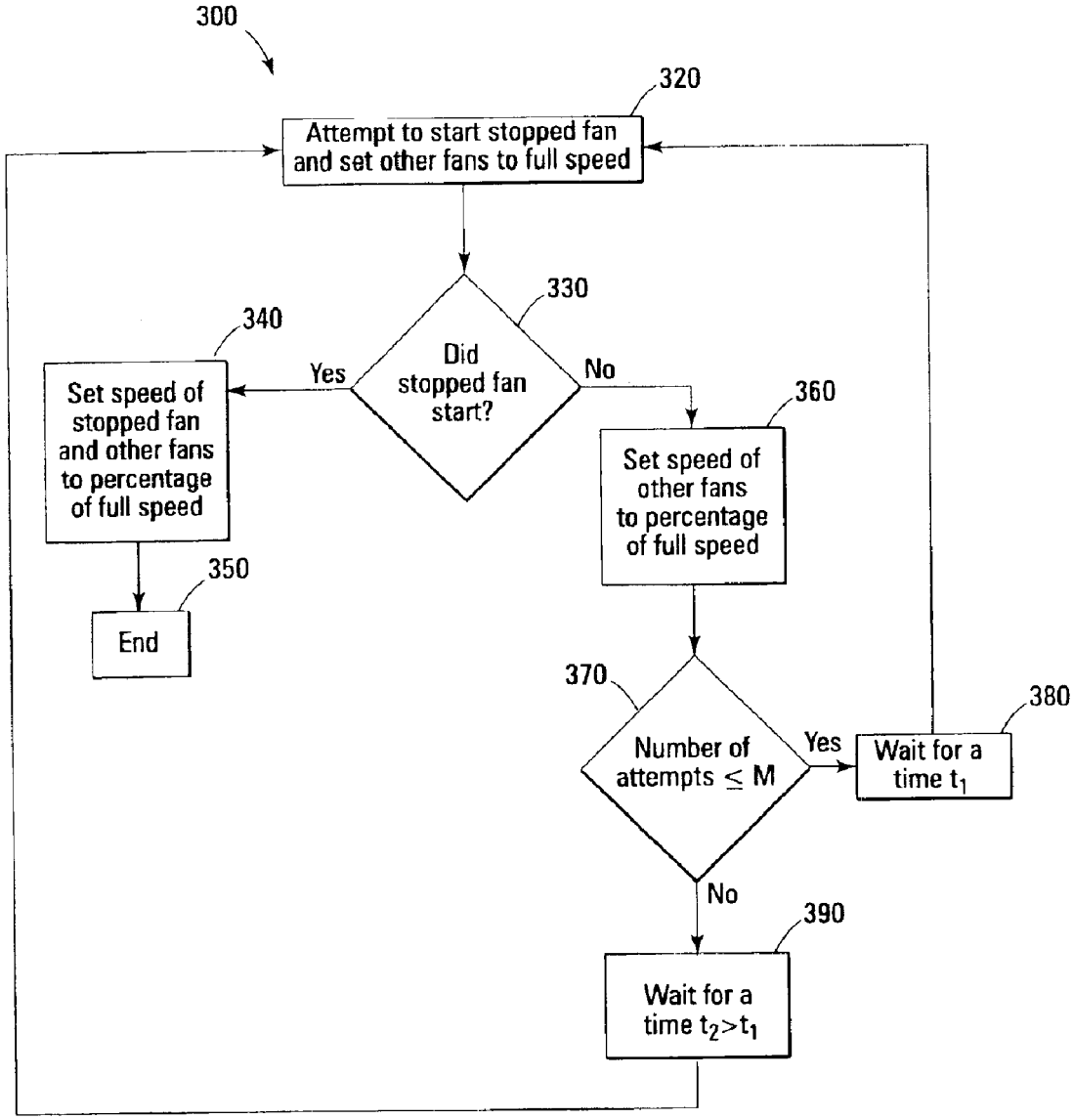
FIG. 3 is a flowchart of a method for restarting a stopped fan according to yet another embodiment of the present invention.

FIG. 3 is a flowchart of an embodiment of a method 300 for restarting a stopped fan, such as fan $104_1$, when the stopped fan and other fans, e.g., fans $104_2$ to $104_N$, are set to operate at a percentage of full speed, e.g., based on the temperature sensed by temperature sensor 114. In one embodiment, the respective one of controllers 102, e.g., controller $102_1$, detected the stopped fan, as described above. At block 320, circuit card 100 attempts to start fan $104_1$ and sets the other fans, e.g., fans $104_2$ to $104_N$, to full speed. In one embodiment, this is accomplished by controller 106 respectively sending control signals via traces $110_1$ to $110_N$ to controllers $102_1$ to $102_N$. The control signal sent to controller $102_1$ instructs controller $102_1$ to send a power signal to fan $104_1$ to start fan $104_1$. The control signals sent to controllers $102_2$ to $102_N$ instruct controllers $102_2$ to $102_N$ to set fans $104_2$ to $104_N$ at full speed. If fan $104_1$ starts, it is decided at decision block 330 to set fans $104_1$ to $104_N$ at a percentage of full speed at block 340, e.g., as per the temperature sensed by sensor 114. Method 300 then ends at block 350. In one embodiment, when the stopped fan starts, controller 106 deactivates alarm indicator 116.

If fan $104_1$ does not start, it is decided at decision block 330 to set fans $104_2$ to $104_N$ at a percentage of full speed at block 340, e.g., as per the temperature sensed by sensor 114, at block 360. Method 300 then proceeds to decision block 370. If the number of attempts to start the fan is less than or equal to e.g., M=3 or 4 attempts, it is decided at decision block 370 to wait for a time interval $t_1$, e.g., $t_1$=4 seconds, at block 380 and to attempt to start fan $104_1$ again and to set fans $104_2$ to $104_N$ at full speed again by returning to block 320. This is repeated for M attempts (or M time intervals $t_1$). If fan $104_1$ does not start after M attempts (or M time intervals $t_1$), it is decided at decision block 370 to wait for a time interval $t_2>t_1$ at block 390 and to attempt to start fan $104_1$ again and to set fans $104_2$ to $104_N$ at full speed again by returning to block 320. It is attempted to start fan $104_1$ and to set fans $104_2$ to $104_N$ at full speed after each of a number of time intervals $t_2$ until the fan starts. Increasing the time interval from $t_1$ to $t_2$ reduces acoustic noise and power consumption associated with increasing the speed of fans $104_2$ to $104_N$ from a fraction of full speed to full speed during each time interval. Method 300 is not limited to restarting only one fan, but can be used to restart any number of fans $104_1$ to $104_N$ that have stopped.

In some embodiments, when temperature sensor 114 senses a temperature less than or equal to a freezing temperature of a lubricant lubricating the fans, thermal shutdown occurs. This involves control card 100 shutting off power to fans $104_1$ to $104_N$. Thermal shutdown persists until temperature sensor 114 senses a predetermined temperature that is greater than the lubricant freezing temperature. At this point, control card 100 restores power to fans $104_1$ to $104_N$. In another embodiment, power to fans $104_1$ to $104_N$ is shut off manually via a manual shutdown. A manual shutdown persists until power is manually restored to fans $104_1$ to $104_N$.

When a stopped-fan fault occurs prior to a thermal or manual shutdown, circuit card 100 retains the fault during the shutdown. In one embodiment, when a stopped-fan fault occurs prior to a thermal or manual shutdown, a method for restarting the stopped fan, such as method 200 or 300, is executed upon detection of the stopped-fan fault. In this embodiment, the thermal or manual shutdown can occur at any point during the execution of the restart method, thus stopping the restart method. In another embodiment, when a stopped-fan fault occurs prior to a thermal or manual shutdown, and power is restored to the fans, e.g., either manually or because temperature sensor 114 senses a predetermined temperature that is greater than the lubricant freezing temperature, the restart method is executed to restart the stopped fan.

Figure 4:
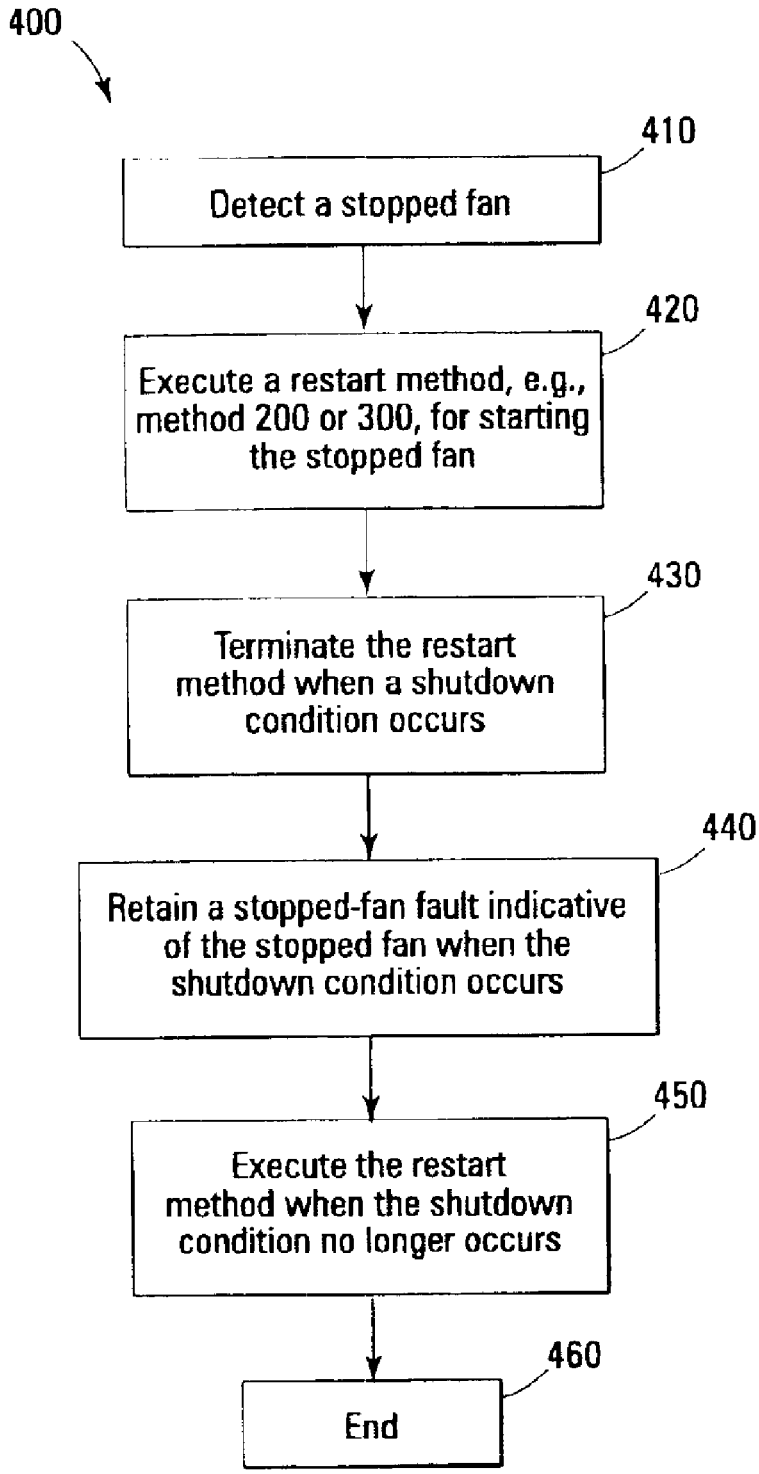
FIG. 4 is a flowchart of a method for controlling fans according to another embodiment of the present invention.

More specifically, FIG. 4 is a flowchart of an embodiment of a method 400 for controlling fans. A stopped fan is detected at block 410. At block 420, a restart method, e.g., method 200 or 300, is executed to start the stopped fan. The restart method is terminated at block 430 when a shutdown condition occurs, such as a thermal or manual shutdown. A stopped-fan fault indicative of the stopped fan is retained at block 440 when the shutdown condition occurs. The restart method is executed at block 450 when the shutdown condition no longer exists, e.g., power is restored to the fans either manually or because temperature sensor 114 senses a predetermined temperature that is greater than the lubricant freezing temperature. In one embodiment, other fans without stopped-fan faults are started when the shutdown condition no longer exists. Method 400 is not limited to restarting only one fan, but can be used to restart any number of fans $104_1$ to $104_N$ that have stopped.

In other embodiments, when temperature sensor 114 senses a temperature greater than or equal to a predetermined high temperature, circuit card 100 activates alarm indicator 116. When temperature sensor 114 senses a temperature below the predetermined high temperature, circuit card 100 deactivates alarm indicator 116.

CONCLUSION

Embodiments of the present invention have been described. The embodiments provide for controlling fans. Some embodiments provide for detecting and restarting one or more stopped fans. Other embodiments provide for retaining stopped-fan faults when a shutdown condition occurs.

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention. It is manifestly intended that this invention be limited only by the following claims and equivalents thereof.

What is claimed is:

1. A method for restarting a stopped fan, the method comprising:

attempting to start the stopped fan while setting at least one other fan at full speed;

setting the at least one other fan at a percentage of full speed after attempting to start the stopped fan;

attempting to start the stopped fan again after at least one first time interval when the fan does not start; and attempting to start the stopped fan again after at least one second time interval when the fan does not start after a predetermined number of first time intervals, wherein the at least one second time interval is longer than the first time interval.

2. The method of claim 1, further comprising setting the stopped fan at a percentage of full speed when the stopped fan starts.

3. A method for restarting a stopped fan, the method comprising:

attempting to start the stopped fan;

setting at least one other fan at full speed while attempting to start the stopped fan;

setting the at least one other fan at a percentage of the full speed that is less than the full speed after attempting to start the stopped fan;

setting the at least one other fan at the full speed again while attempting to start the stopped fan again after waiting at least one first time interval when the stopped fan does not start; and setting the at least one other fan at the full speed again while attempting to start the stopped fan again after waiting at least one second time interval when the stopped fan does not start after a predetermined number of first time intervals, wherein the at least one second time interval is longer than the first time interval.

4. The method of claim 3, further comprising setting the stopped fan at a percentage of full speed when the stopped fan starts.

5. The method of claim 4, wherein setting the stopped fan at a percentage of full speed when the stopped fan starts occurs at a temperature within a predetermined range.

6. The method of claim 3, wherein setting the at least one other fan at a percentage of full speed occurs at a temperature within a predetermined range.

7. A method for controlling fan operation, the method comprising:

detecting a stopped fan;

attempting to start the stopped fan;

setting at least one other fan at full speed while attempting to start the stopped fan;

setting the at least one other fan at a percentage of full speed after attempting to start the stopped fan;

attempting to start the stopped fan again after at least one first time interval when the fan does not start; and attempting to start the stopped fan again after at least one second time interval when the fan does not start after a predetermined number of first time intervals, wherein the at least one second time interval is longer than the first time interval.

8. The method of claim 7, further comprising setting the stopped fan at a percentage of full speed when the stopped fan starts.

9. The method of claim 7, further comprising activating an alarm upon detecting the stopped fan.

10. The method of claim 7, further comprising deactivating an alarm when the stopped fan starts.

11. A method for controlling fan operation, the method comprising:

detecting a stopped fan; attempting to start the stopped fan while setting at least one other fan at full speed;

setting the at least one other fan at a percentage of the full speed that is less than the full speed after attempting to start the stopped fan;

attempting to start the stopped fan again while setting the at least one other fan at the full speed again after at least one first time interval when the stopped fan does not start; and attempting to start the stopped fan again while setting the at least one other fan at the full speed again after at least one second time interval when the stopped fan does not start after a predetermined number of first time intervals, wherein the at least one second time interval is longer than the first time interval.

12. The method of claim 11, further comprising setting the stopped fan at a percentage of full speed when the stopped fan starts.

13. The method of claim 12, wherein setting the stopped fan at a percentage of full speed when the stopped fan starts occurs at a temperature within a predetermined range.

14. The method of claim 11, wherein setting the at least one other fan at a percentage of full speed occurs at a temperature within a predetermined range.

15. A method for controlling fan operation, the method comprising:

detecting a stopped fan;

executing a restart method for starting the stopped fan where the restart method includes:

attempting to start the stopped fan while setting at least one other fan at full speed;

setting the at least one other fan at a percentage of the full speed that is less than the full speed after attempting to start the stopped fan;

attempting to start the stopped fan again while setting the at least one other fan at the full speed again after at least one first time interval when the stopped fan does not start; and attempting to start the stopped fan again while setting the at least one other fan at full speed again after at least one second time interval when the stopped fan does not start after a predetermined number of first time intervals, wherein the at least one second time interval is longer than the first time interval;

terminating the restart method when a shutdown condition occurs;

retaining a stopped-fan fault indicative of the stopped fan when the shutdown condition occurs; and executing the restart method for starting the stopped fan when the shutdown condition no longer exists.

16. A method for controlling fan operation, the method comprising:

detecting a stopped fan;

shutting off power to the stopped fan at a temperature corresponding to a freezing temperature of a lubricant of the stopped fan;

retaining a stopped-fan fault indicative of the stopped fan when the power is shut off;

restoring power to the stopped fan at a temperature greater than the freezing temperature of the lubricant; and executing a restart method for starting the stopped fan.

17. A machine-readable medium comprising machine-usable instructions for causing a circuit card to perform a method of controlling fan operation, the method comprising:

detecting a stopped fan;

attempting to start the stopped fan while setting at least one other fan at full speed;

setting the at least one other fan at a percentage of full speed after attempting to start the stopped fan;

attempting to start the stopped fan again after at least one first time interval when the fan does not start; and attempting to start the stopped fan again after at least one second time interval when the fan does not start after a predetermined number of first time intervals, wherein the at least one second time interval is longer than the first time interval.

18. The method of claim 17, further comprising setting the stopped fan at a percentage of full speed when the stopped fan starts.

19. The method of claim 17, further comprising activating an alarm upon detecting the stopped fan.

20. The method of claim 17, further comprising deactivating an alarm when the stopped fan starts.

21. A machine-readable medium comprising machine-usable instructions for causing a circuit card to perform a method of restarting a stopped fan, the method comprising:

attempting to start the stopped fan while setting at least one other fan at full speed;

setting the at least one other fan at a percentage of full speed after attempting to start the stopped fan;

attempting to start the stopped fan again after at least one first time interval when the fan does not start; and attempting to start the stopped fan again after at least one second time interval when the fan does not start after a predetermined number of first time intervals, wherein the at least one second time interval is longer than the first time interval.

22. The method of claim 21, further comprising setting the stopped fan at a percentage of full speed when the stopped fan starts.

23. A machine-readable medium comprising machine-usable instructions for causing a circuit card to perform a method of controlling fan operation, the method comprising:

detecting a stopped fan;

executing a restart method for starting the stopped fan where the restart method includes;

attempting to start the stopped fan while setting at least one other fan at full speed;

setting the at least one other fan at a percentage of the full speed that is less than the full speed after attempting to start the stopped fan;

attempting to start the stopped fan again while setting the at least one other fan at the full speed again after at least one first time interval when the stopped fan does not start; and attempting to start the stopped fan again while setting the at least one other fan at full speed again after at least one second time interval when the stopped fan does not start after a predetermined number of first time intervals, wherein the at least one second time interval is longer than the first time interval;

terminating the restart method when a shutdown condition occurs;

retaining a stopped-fan fault indicative of the stopped fan when the shutdown condition occurs; and executing the restart method for starting the stopped fan when the shutdown condition no longer exists.

* * * * *